US005452734A

United States Patent [19]

Steeves

[11] Patent Number: 5,452,734

[45] Date of Patent: Sep. 26, 1995

[54] PAINT ROLLER CLEANER

[76] Inventor: Christopher C. Steeves, 970 Killarney Cres., Kingston, Ont., Canada, K7M 6G7

[21] Appl. No.: 376,937

[22] Filed: Jan. 23, 1995

[51] Int. Cl.[6] ..... B08B 3/04

[52] U.S. Cl. ..... 134/186; 15/236.03; 134/900

[58] Field of Search ..... 134/900, 186; 15/236.03

[56] References Cited

U.S. PATENT DOCUMENTS

| | | | |
|---|---|---|---|
| 3,577,280 | 11/1971 | George | 134/138 |
| 3,731,697 | 9/1973 | Yost | 134/138 |
| 3,886,960 | 6/1975 | Krueger | 134/138 |
| 4,606,777 | 10/1986 | Brow | 134/138 X |
| 4,735,221 | 2/1988 | Vegiard | 134/138 |
| 4,809,772 | 5/1989 | Pennise | 134/138 |

*Primary Examiner*—Philip R. Coe
*Attorney, Agent, or Firm*—Richard J. Hicks

[57] ABSTRACT

A pressure cleaning device for cleaning paint from a paint roller is described. An elongated housing of any selected cross section having an open end and a closed end is provided with a solvent inlet either adjacent to or in the closed end and a flexible seal partially closing the open end. A paint roller is forced into the cylinder past the flexible seal and pumped up and down two or three times so that solvent pressure builds up in the cylinder and cleans the roller quickly and with minimum solvent use. In a preferred embodiment the paint is a water based paint and the solvent is water.

9 Claims, 2 Drawing Sheets

PAINT ROLLER CLEANER

FIELD OF INVENTION

This invention relates to a device for washing paints out of a roller after use in painting. More specifically, the invention provides a high pressure cleaning device which can be affixed to a domestic water supply for cleaning water based paint from a roller.

BACKGROUND OF INVENTION

There are of course, many ways to remove paint and particularly water-based paints from a paint roller after use, including repeated rinsings under a water tap on repeated immersions in a bucket, or buckets, of water or other suitable solvent with or without hard squeezing to remove the paint. This is, of course, rather messy and disposal of the relatively large quantities of waste solvent may constitute a problem. Various tubular devices which can be affixed to water supply hoses and the like have been suggested and attention is, directed to U.S. Pat. Nos. 4,735,221; 4,809,722; 4,606,777; 3,577,280 and 3,886,960 which variously describe tubular housings to receive a paint roller and means to introduce water either via a single jet as in U.S. Pat. No. 4,606,777 or distribute through a plurality of jets spaced along the length of the roller, as in U.S. Pat. No. 3,577,280. These housings and,jets clean the roller placed therein reasonably efficiently but require a considerable amount of water to do so. There is a need, therefore, for an improved paint roller cleaner which can quickly and efficiently remove the paint using a minimum of water.

OBJECT OF THE INVENTION

It is an object of the present invention to provide an improved paint roller cleaner which uses elevated pressure to enhance the speed of cleaning.

BRIEF STATEMENT OF INVENTION

By one aspect of this invention there is provided a device for cleaning paint from a paint roller, comprising: elongated housing means having an open first end and a closed second end adapted to receive and contain said paint roller; solvent inlet means in one of said second end of said cylinder and a side wall of said housing adjacent said second end; resiliently flexible sealing means partially closing said first end of said cylinder, and adapted for movable sealing engagement with said paint roller as it is inserted and withdrawn from said housing means.

DETAILED DESCRIPTION OF PREFERRED EMBODIMENT

Figure 1:
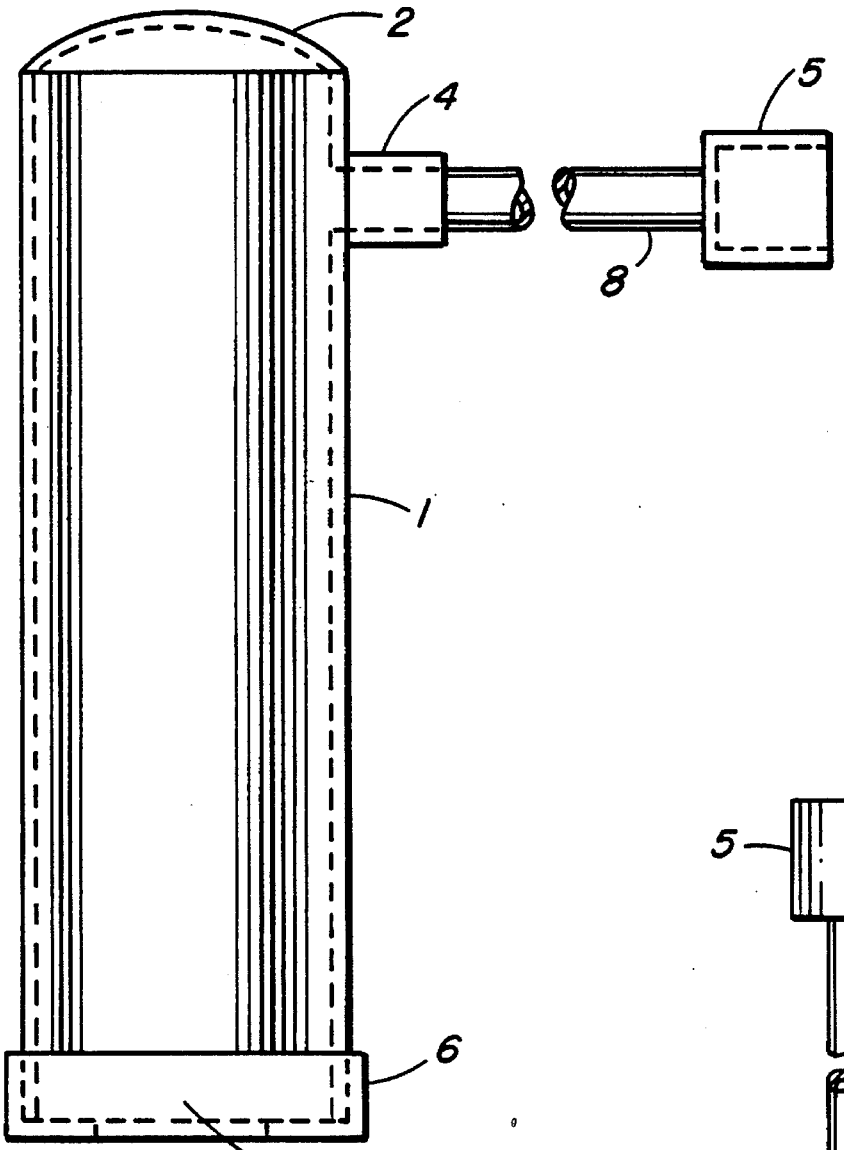
FIG. 1 is a sketch of a side view of the housing of one embodiment of the present invention.
Figure 3:
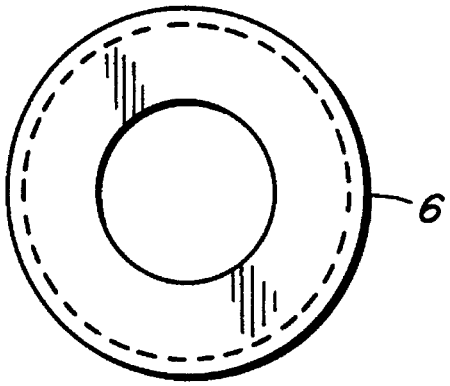
FIG. 3 is a top plan view of the housing of FIG. 1.
Figure 2:
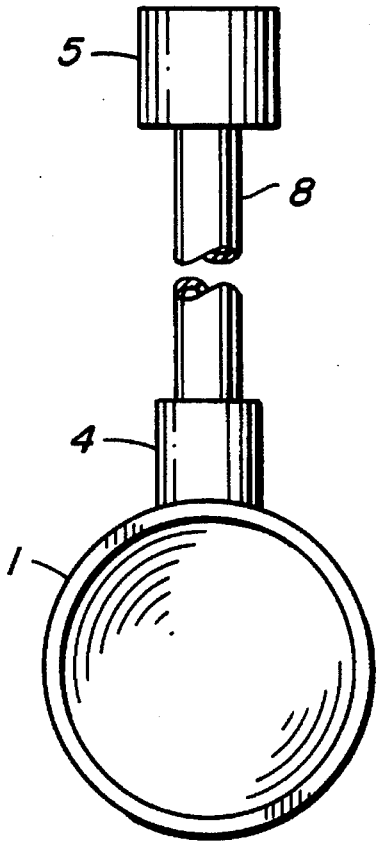
FIG. 2 is a bottom plan view of the housing of FIG. 1.

As seen in FIG. 1, a cylinder 1, in operative position, provided with a closed upper end 2 and an open lower end 3, fabricated from any suitable material such as a thermoplastic material such as polyethylene, or a metallic material such as an aluminum tube. Typically, but not essentially, cylinder 1 is about 3 inches in diameter and about 15 inches long. Proximal or in end 2 there is provided a solvent inlet fitting 4 for attachment to a pressure solvent source 5. In a preferred embodiment the solvent source is a water source. End 3 is partially closed by a planar flexible rubber (or similar) seal 6, as seen more clearly in FIG. 3. Flexible seal 6 has an internal diameter adapted to receive and resiliently sealingly engage with different diameter rollers with different lengths or pile. Seal 6 may be screwed, resiliently engaged, or otherwise secured to open end 3.

Figure 4:
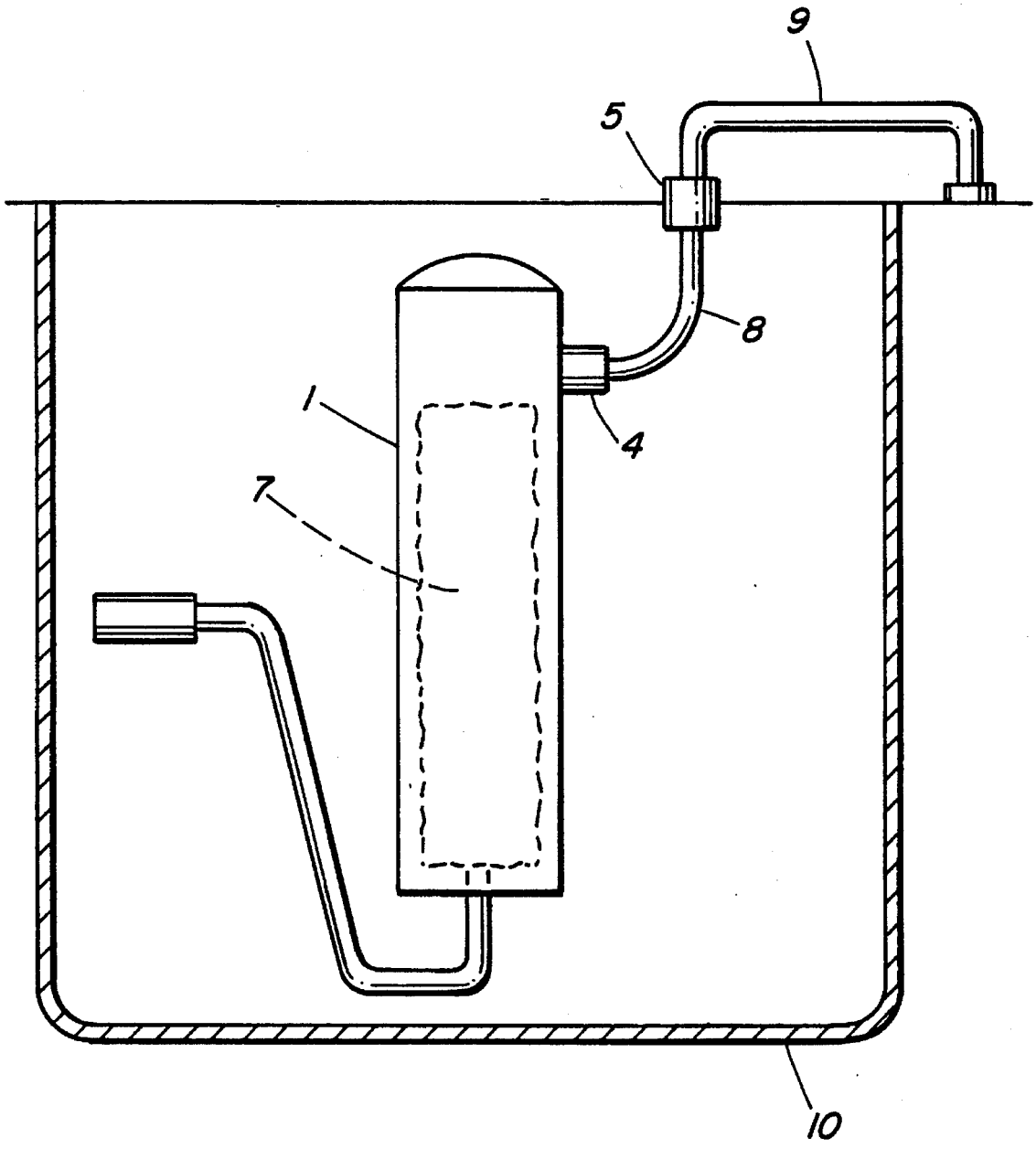
FIG. 4 is a sketch, partly in section of a roller being cleaned in the device of the present invention.

As seen in FIG. 4, water from source 5 is turned on, and cylinder 1 is forced downwardly over the water based paint filled roller 7 through resilient flexible seal 6, displacing the water contained in the cylinder 1. The cylinder is then partially withdrawn and again forced downwardly against the pressure of the water in the cylinder. This pumping action enhances the water pressure and effectively and quickly cleans the paint out of the roller. Two or three strokes are usually sufficient to clean both the roller fabric and the interoir of the roller housing and the spindle of any adhering paint. It will be appreciated that only a very small volume of water, equivalent to only two or three times the volume of the cylinder are required to effect cleaning.

It will be appreciated that although the invention has been thus far described with particular reference to the use of water as the solvent to clean water based paint out of the roller, the principles of this invention are equally suited to cleaning oil based paint from a roller, provided a pressure source of an appropriate organic solvent such a petroleum distillate sold under the tradename "Varsol" or an aromatic solvent such as benzene or toluene or a water-solubilizing agent such as that sold under the trademark Polyclens, is available. Other modifications will also be apparent to those skilled in the art, for example while a cylindrical housing having a circular cross section has been described, other elongated housings having noncircular cross sections may equally well be employed.

I claim:

1. A device for cleaning paint from a paint roller, comprising: elongated housing means having an open first end and a closed second end adapted to receive and contain said paint roller; solvent inlet means in one of said second end of said cylinder and a side wall of said housing adjacent said second end: resiliently flexible sealing means partially closing said first end of said cylinder, and adapted for movable sealing engagement with said paint roller as it is inserted and withdrawn from said housing means.

2. A device for cleaning paint rollers as claimed in claim 1 wherein said elongated housing means is a cylinder having a circular cross section.

3. A device for cleaning paint rollers as claimed in claim 2 wherein said solvent inlet means is operatively connected to a pressure solvent supply means.

4. A device for cleaning paint rollers as claimed in claim 3 wherein said solvent supply means is a water source and said paint is a water-based paint.

5. A device for cleaning paint rollers as claimed in claim 1 wherein said resiliently flexible sealing means is adapted to sealingly engage with the circumference of a roller having a diameter within a selected range of diameters.

6. A device for cleaning paint rollers as claimed in claim 1 wherein said sealing means resiliently engages an outer circumference of said housing means.

7. A device for cleaning paint rollers as claimed in claim 1 wherein said sealing means includes cap means for engaging said housing means.

8. A device for cleaning paint rollers as claimed in claim 7 wherein said cap means includes screw thread means operatively connected to said housing means.

9. A device for cleaning paint rollers as claimed in claim 1 wherein said sealing means is adhesively secured to said housing means.

* * * * *